US005130560A

United States Patent [19]

Morishita et al.

[11] Patent Number: 5,130,560

[45] Date of Patent: Jul. 14, 1992

[54] ENGINE STARTER

[75] Inventors: Akira Morishita; Takeshi Sugiyama, both of Hyogo, Japan

[73] Assignee: Mitsubishi Denki K. K., Tokyo, Japan

[21] Appl. No.: 778,758

[22] Filed: Oct. 18, 1991

Related U.S. Application Data

[63] Continuation of Ser. No. 578,484, Sep. 7, 1990, abandoned.

[30] Foreign Application Priority Data

Sep. 9, 1989 [JP] Japan ..... 1-105522
Sep. 20, 1989 [JP] Japan ..... 1-110645

[51] Int. Cl.[5] ..... F02N 11/00
[52] U.S. Cl. ..... 290/38 R; 290/48; 310/93
[58] Field of Search ..... 290/38 R, 48; 310/93

[56] References Cited

U.S. PATENT DOCUMENTS 1,860,504 5/1932 James ..... 310/93
4,308,462 12/1981 McMillen ..... 290/38 R

FOREIGN PATENT DOCUMENTS 18696 3/1989 Japan .

*Primary Examiner*—A. D. Pellinen
*Assistant Examiner*—Robert Lloyd Hoover
*Attorney, Agent, or Firm*—Sughrue, Mion, Zinn, Macpeak & Seas

[57] ABSTRACT

An engine starter comprises an electric motor for starting an engine when the motor is energized, an electromagnetic switch including a pair of normally-open contacts connected to each other to form an energizing circuit for the motor at the time of energizing a coil of the switch, and a pair of normally-closed contacts connected to each other to form a grounding circuit for the motor at the time of de-energizing of said coil, and a restriction device for restricting a braking electrical current generated due to an inertial rotation of the motor.

3 Claims, 2 Drawing Sheets

ENGINE STARTER

This is a continuation of application No. 07/578,484 filed Sep. 20, 1991, now abandoned.

BACKGROUND OF THE INVENTION

The present device relates to an engine starter, particularly to the improvement of a braking current restriction means for an electric motor for starting an engine.

There is known an engine starter disclosed in the Japanese Utility Model Application No. 8696/89. The engine starter is described with reference to FIG. 1. The engine starter 1 is a magnet-employing starter of the electromagnetic push-in type and includes a DC motor 2 and an electromagnetic switch 3 attached to the motor. The DC motor 2 includes a permanent magnet having magnetic poles 4 for driving an armature 5 of the motor, and plus and minus brushes 6 and 7 disposed in slip contact with the armature. The electromagnetic switch 3 includes a main contact unit 8 consisting of a pair of fixed contacts 9*a* and 9*b* and a movable contact 11, which is put into and out of touch with the fixed contacts by a movable iron core 10, a pair of normally-closed fixed contacts 12*a* and 12*b* opposed to the movable contact 11, a current coil 13 for attaching the movable iron core 10, and a voltage coil 14 for keeping the iron core attracted. The 16. The normally-closed fixed contact 12*a* is grounded. The current coil 13 and the plus brush 6 are grounded when the electromagnetic switch 3 is de-energized. The other normally-closed fixed contact 12*b* is connected to the current outgoing terminal 17 of the current coil 13 and to the normally open fixed contact 9*b*.

Since the field means of the DC motor 2 of the conventional engine starter 1 described above entirely made of the permanent magnet 4, a high voltage is generated between the plus and the minus brushes 6 and 7 when the armature 5 is inertially rotated in the magnetic field of the permanent magnet. Besides, since the brushes 6 and 7 are grounded at that time, a braking current of excessive magnitude flows so that the contacts are fuse-bonded, the components of the electromagnetic switch 3 are thermally deteriorated and the armature 5 is abruptly stopped making a loud noise. These are problems.

It is an object of the present invention to provide an engine starter in which a braking current generated due to the inertial rotation of an armature is restricted.

In accordance with the above object the invention provides an engine starter comprising an electric motor for starting an associated engine when the motor is energized, and an electromagnetic switch including a pair of normally opened contacts connected to each other to form an energizing circuit for the motor at the time of energizing a coil of the switch, and a pair of normally closed contacts connected to each other to form a grounding circuit through a restrictive output device for said motor at the time of de-energizing the coil. A first restriction means restricts the kinetic energy generated due to the inertial rotation of the armature, and a second restriction means restricts a braking electrical current due to the rotation of the armature in a magnetic field. The first restriction means includes a permanent magnet and at least one pair of electromagnets neighboring each other. The second restriction means includes the restrictive output device.

DETAILED DESCRIPTION OF THE PREFERRED EMBODIMENTS

Figure 1:
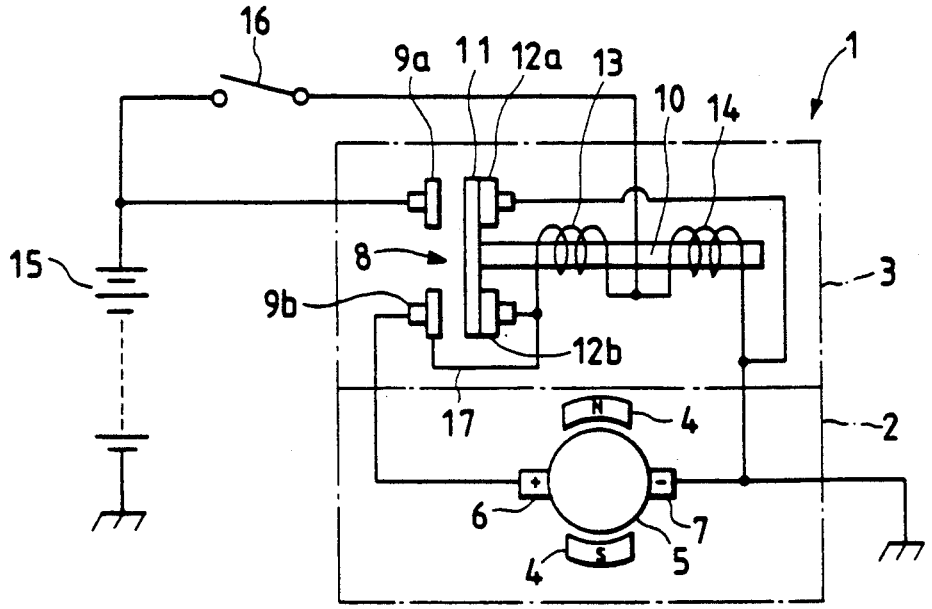
FIG. 1 PRIOR ART
FIG. 1 is a wiring diagram of a conventional engine starter.
Figure 2:
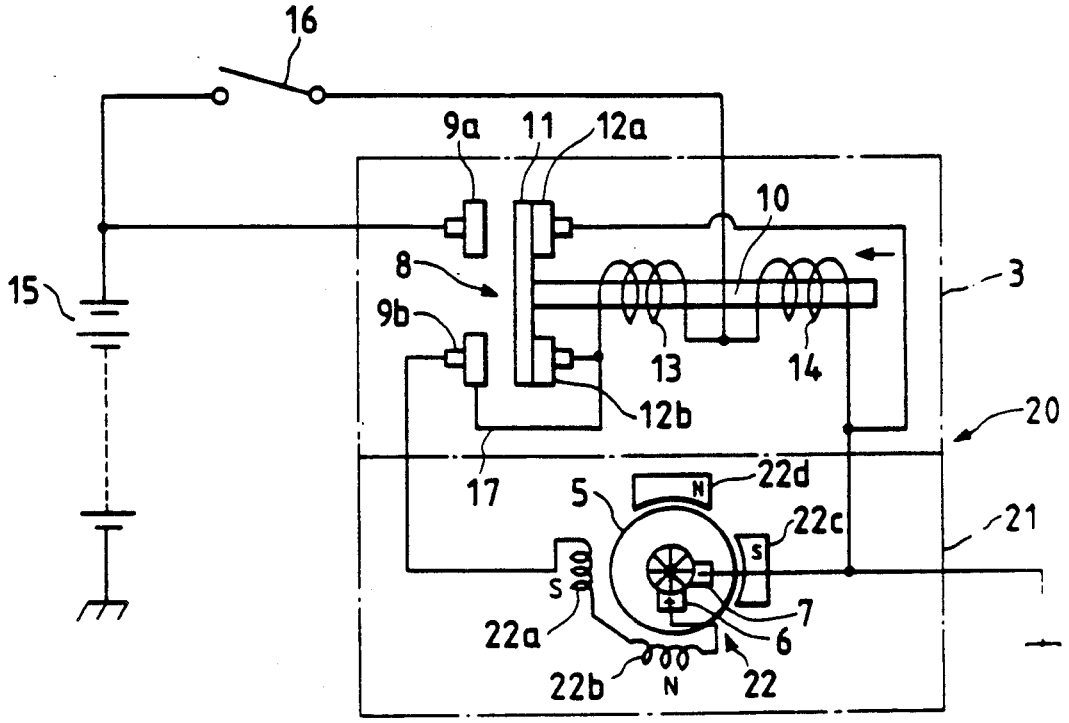
FIG. 2 is a wiring diagram of an engine starter which is an embodiment of the present device.

The invention will now be described with reference to the drawings. FIG. 2 shows an engine starter 20 which is one of the embodiments according to present invention. The engine starter according to the present invention is composed of substantially the same components as those shown in FIG. 1 except for the parts described hereinbelow. Accordingly, the duplicated description will be omitted. The engine starter 20 includes an electromagnetic switch 3 and a DC motor 21 having a four-pole field device 22 made of a pair of mutually-neighboring electromagnets 22*a* and 22*b* and a pair of mutually-neighboring permanent magnets 22*c* and 22*d*. The electromagnet 22*a* has south pole opposed to the armature 5 of the DC motor 21. One terminal of the coil of the electromagnet 22*a* is connected to fixed contact 9*b*, and the other terminal of the coil is connected to one terminal of the coil of the-other electromagnet 22*b* connected to a plus brush 6. A minus brush 7 is grounded.

When the armature 5 begins to inertially rotate, only the portion of the coil of the armature, which is located in the magnetic fields of the permanent magnets 22*c* and 22*d* of the field device 22, receives an electromagnetic braking action and a braking current generated due to the inertial rotation of the armature is consequently made less than that in the conventional engine starter. When the DC motor 21 is de-energized by disconnecting normally-open contact 9*a* and 9*b* from each other, the electrical currents in the field coils of the electromagnets 22*a* and 22*b* are nearly instantaneously made zero so that no magnetic field is applied to the inertially rotating armature 5 by the electromagnets 22*a* and 22*b*. For that reason, nearly no electromagnetic braking force generated by the electromagnets 22*a* and 22*b* is applied to the armature 5.

Figure 3:
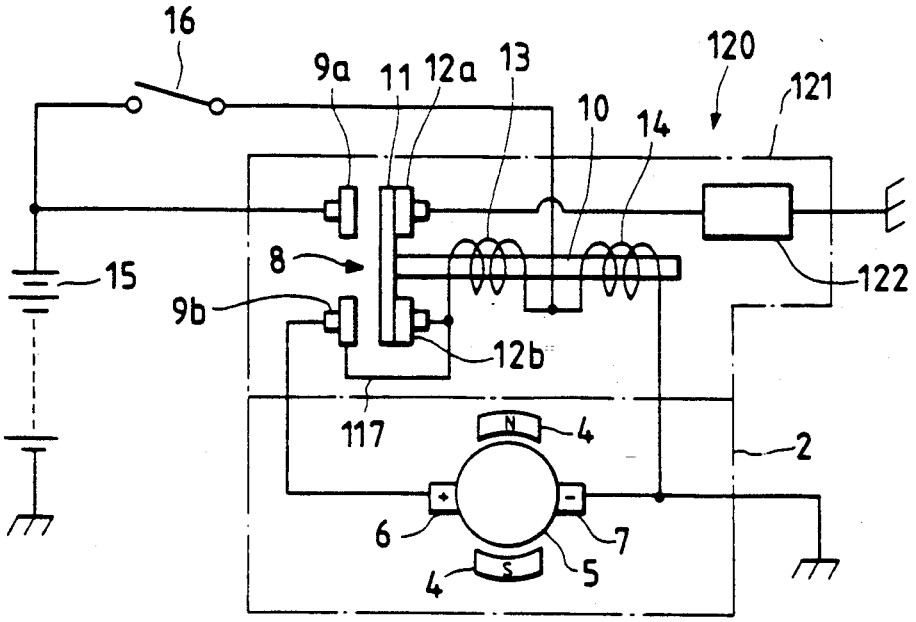
FIG. 3 is a wiring diagram of an engine starter which is another embodiment of the present device.

FIG. 3 shows a starter 120 which is another embodiment of the present invention. The engine starter according to the present invention is composed of substantially the same components as those shown in FIG. 1 except for the parts described hereinbelow. Accordingly, the duplicated description will be omitted. The engine starter 120 includes an electromagnetic switch 121 and a DC motor 2. The switch 121 includes an output device 122 connected between a normally-closed fixed contact 12*a* and ground so as to make a sound.

When the armature 5 of the engine starter 120 begins to inertially rotate, a braking current is generated in the coil of the armature because of the rotation thereof in the magnetic fields of a pair of permanent magnets 4 constituting the field device of the DC motor, so that an electromagnetic braking force acts to brake the rotation of the armature thereof. At that time, the braking current flows from the coils of the armature 5 to the output device 122 so that the sound is made. Since the output device 122 acts as a resistor to the braking current, the current is made much less than in the case when the current flows directly into the ground. Thus, the electromagnetic braking force which acts on the armature 5 is reduced so that the armature is prevented from being abruptly stopped. Besides, an unpleasant noise made at the time of the stoppage of the armature 5 is overwhelmed by the sound made by the output device 22.

Figure 4:
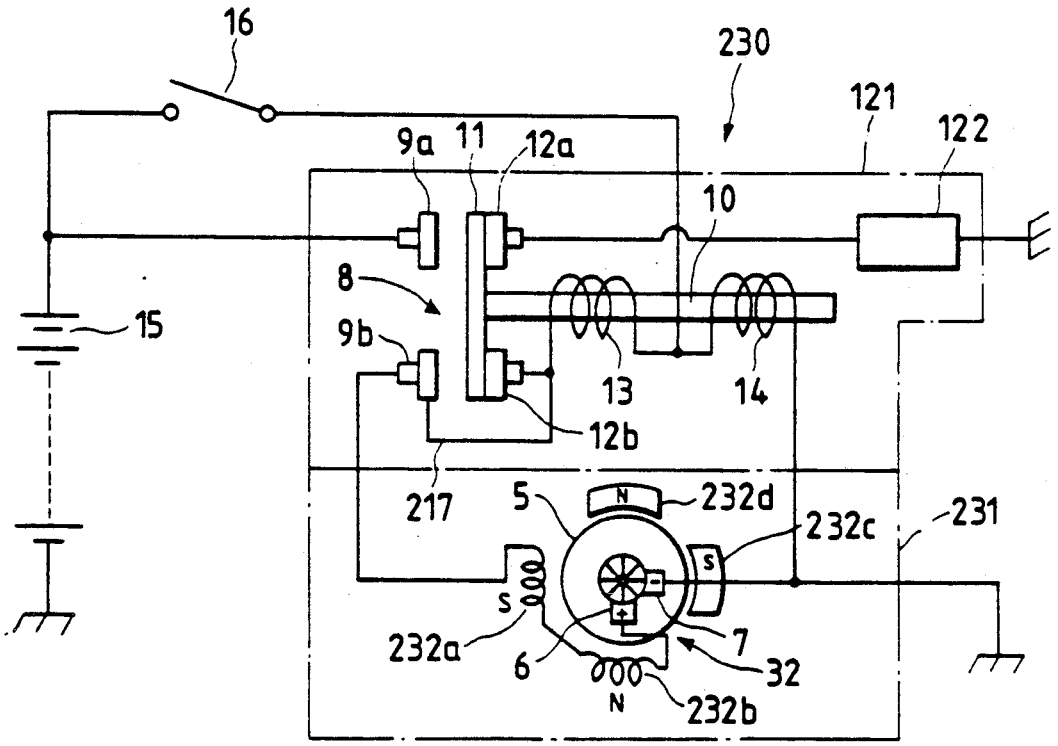
FIG. 4 is a wiring diagram of an engine starter which is yet another embodiment of the present device.

FIG. 4 shows a starter 230 which is another embodiments of the present invention and is composed of substantially the same components as those shown in FIG. 1 except for the parts described hereinbelow. Accordingly, the duplicated description will be omitted. The engine starter 230 includes an electromagnetic switch 121 and a DC motor 231. The DC motor 231 includes a four-pole field device 32 made of a pair of mutually-neighboring electromagnets **232*a* and 232*b* and a pair of mutually-neighboring permanent magnets 232*c* and 232*d*. The electromagnet 232*a* has a south pole opposed to the armature 5 of the DC motor 231. One terminal of the coil of the electromagnetic 232*a* is connected to a fixed contact 9*b*, and the other terminal of the coil is connected to one terminal of the coil of the other electromagnet 232*b*, the other terminal of the coil of which is connected to a plus brush 6. An minus brush 7** is grounded.

When the armature 5 of the engine starter 230 begins inertially rotate, only the portion of the coil of the armature 5, which is located in the magnetic fields of the permanent magnets **232*c* and 232*d* of the field device 32, receives an electromagnetic braking action and a braking current generated due to the rotation of the armature flows through an output device 122 so that the current is made very small. When the DC motor 231 is de-energized by disconnecting normally-open contacts 9*a* and 9*b* from each other, the electrical currents in the field coils of the electromagnets 232*a* and 232*b* are nearly instantaneously made zero so that no magnetic field is applied to the inertially rotating armature 5 by the electromagnets. For that reason, nearly no electromagnetic braking force is applied to the inertially rotating armature 5 by the electromagnets 232*a* and 232*b*. In addition, the output device 122 acts as a resistor to the braking current as the current flows from the coil of the armature 5** to the output device, so that a sound is made by the device.

Since the braking current generated due to the inertial rotation of the armature 5 of the engine starter 230 is, thus restricted to be very small, the contact are prevented from being fuse-bonded, the components of the electromagnetic switch 121 are not thermally deteriorated and the armature is not abruptly stopped. Beside, a noise made at the time of the stoppage of the armature 5 is overwhelmed by the sound made by the output device 122. Therefore, the engine starter 230 is enhanced in quality.

In an engine starter of the present invention, an output device for making a sound is connected between a normally-closed fixed contact and ground so as to restrict a braking current generated due to the inertial rotation of an armature. For that reason, the contacts are prevented from being fuse-bonded, the components of a switch are not thermally deteriorated and the armature is not abruptly stopped. Besides, an unpleasant noise made due to the stoppage of the armature is overwhelmed by the sound made by the output device.

In another engine starter of the present invention, an electrical current is generated in the coil of an armature when the armature inertially rotates across the magnetic field of the permanent magnet of a field device. For that reason, an electromagnetic braking force acts to the armature to brake the rotation thereof. Since an output device for making a sound acts as a resistor to the electrical current generated in the coil of the armature, the current is reduced. For that reason, the electromagnetic braking force which acts on the armature is restricted so that the armature is prevented from being abruptly stopped. Besides, an unpleasant noise made due to the stoppage of the armature is overwhelmed by the sound made by the output device.

What is claimed is:

1. An engine starter comprising:

an electric motor for starting an associated engine when said motor is energized;

an electromagnetic switch including a pair of normally-opened contacts connected to each other to form an energizing circuit for said motor at the time of energizing a coil of said switch, and a pair of normally-closed contacts connected to each other to form a grounding circuit for said motor at the time of de-energizing of said coil;

first restriction means for restricting kinetic energy generated due to a rotating armature of said motor; and second restriction means for restricting a braking electrical current generated due to an inertial rotation of said motor, said restriction means including a permanent magnet and at least one pair of electromagnets neighboring each other.

2. An engine starter as claimed in claim 1, wherein said restriction means further comprises a resistive output device connected between one of said normally-closed contacts and a ground.

3. An engine starter as claimed in claim 1, wherein said restriction means includes a permanent magnet and at least one pair of electromagnets neighboring each other, and a resistive output device connected between one of said normally-closed contacts and a ground.

* * * * *